US005499722A

United States Patent [19]

Goldring

[11] Patent Number: 5,499,722

[45] Date of Patent: Mar. 19, 1996

[54] PRODUCT DISPENSER INCLUDING FIXED QUANTITY DISPENSING ARRANGEMENT

[75] Inventor: Harold B. Goldring, Woodcliff Lake, N.J.

[73] Assignee: Godring Display Group, Inc., Paramus, N.J.

[21] Appl. No.: 324,227

[22] Filed: Oct. 17, 1994

[51] Int. Cl.[6] ..... A47F 5/00

[52] U.S. Cl. ..... 211/57.1; 211/106; 248/220.41; 248/222.52

[58] Field of Search ..... 211/57.1, 59.1, 211/106; 248/220.3, 220.4, 221.1, 222.1, 551

[56] References Cited

U.S. PATENT DOCUMENTS 4,405,051 9/1983 Thalenfeld ..... 211/57.1
4,463,510 8/1984 Windish ..... 211/57.1 X
4,976,058 12/1990 Valiulis ..... 211/59.1 X
5,236,163 8/1993 Valiulis ..... 211/57.1 X
5,348,167 9/1994 Jensen ..... 211/57.1

*Primary Examiner*—Robert W. Gibson, Jr.
*Attorney, Agent, or Firm*—Anthony F. Cuoco

[57] ABSTRACT

A product dispenser of the type for dispensing cards having products encapsulated thereon has a dispensing section and supports a retaining element at a fixed position relative to the dispensing section, whereby only a fixed quantity of cards can be easily removed from the product dispenser to avoid pilferage and the like as might occur by removing more than the fixed quantity of cards.

6 Claims, 2 Drawing Sheets

PRODUCT DISPENSER INCLUDING FIXED QUANTITY DISPENSING ARRANGEMENT

BACKGROUND OF THE INVENTION

A variety of products such as batteries, nuts and bolts, hooks and other such hardware products are packaged by encapsulating the products on cards whereby the familiar "blister" or "bubble" product cards are formed. Modern merchandising techniques feature these cards supported on dispensers mounted on perforated (peg) boards, slat walls or other like mounting surfaces. The dispensers are generally unattended for self-service merchandising. Problems exist in that under the above described circumstances, the product cards can be easily removed, either maliciously or inadvertently, from heretofore available dispensers. Various means have been employed to avoid this situation, such as illustrated in commonly assigned U.S. Pat. No. 5,014,949 issued to Mark A. Niven on May 14, 1991.

A problem also exists in that the product cards can be easily removed from the dispenser in quantities, as may be attempted by pilferers or the like. Prior to the present invention, there has not been a satisfactory fixed quantity dispensing arrangement associated with product dispensers for product cards of the type described.

The product dispensers herein disclosed are configured to include a retaining element which is arranged with the product dispenser at a predetermined position on the dispenser so that the quantity of product cards that can be dispensed at one time is fixed. The configuration is such that unauthorized removal of a quantity of product cards from the dispensers, other than the fixed quantity (usually one), as by pilferers or the like is impeded. All in all, the present invention avoids the problems occasioned by prior art dispensers relating to pilferage and enhances self-serving merchandising of the products as is desireable.

SUMMARY OF THE INVENTION

This invention contemplates a product dispenser of the type for dispensing products which are encapsulated on cards. The cards have apertures near the top edge thereof which engage the dispenser for supporting the cards thereon. The dispenser has a mounting section for supporting the dispenser on a mounting surface, an elongated card supporting section extending outwardly from the mounting section for supporting a plurality of product cards and a dispensing section extending outwardly from the supporting section. A member extends longitudinally and above and substantially parallel to the product card supporting section. The member supports a retaining element at a fixed position relative to the end of the dispensing section so as to enable only a fixed quantity of product cards to be removed from the dispensing section. The retaining element is arranged so that it can be easily attached to the member, while an overt manipulation is required to remove the retaining element from said member. The arrangement described insures that only a predetermined fixed quantity of product cards (usually one) can be easily removed from the product dispenser whereby a pilferer attempting to remove other than the fixed quantity of product cards will have to spend a longer than normal amount of time at the dispenser display, and therefore may be more readily detected.

DETAILED DESCRIPTION OF THE INVENTION

Figure 1:
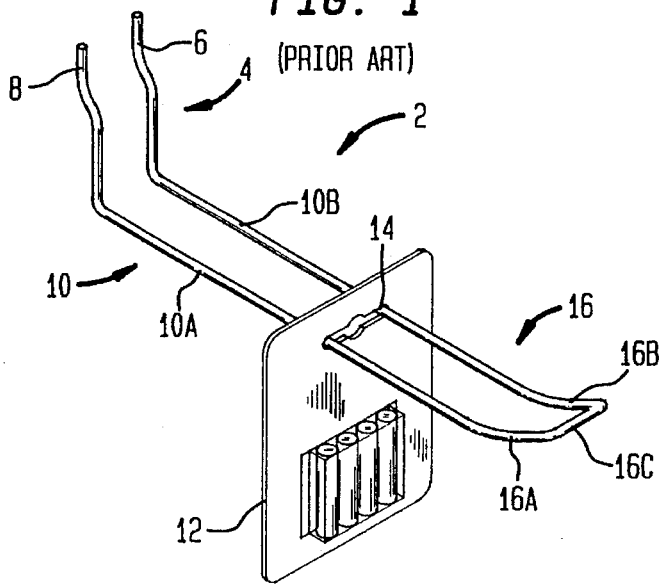
FIG. 1 (PRIOR ART)
FIG. 1 is a perspective view illustrating a form of prior art product dispenser.

With reference to FIG. 1, a prior art product dispenser is designated generally by the numeral 2. Product dispenser 2 is of a double wire form. That is to say, the dispenser is formed from a continuous length of wire bent or otherwise formed to provide two substantially parallel members.

Dispenser 2 has a mounting section 4 including a pair of substantially parallel hooks 6 and 8 which fit into the holes of a pegboard or the like (not otherwise shown) for mounting the dispenser thereto. An elongated card supporting section 10 has arms 10A and 10B extending outwardly from mounting section 4 and substantially normal thereto. Elongated card supporting section 10 supports a plurality of product cards 12, only one of which is shown for purposes of illustration. Product cards 12 have an aperture 14 near the top thereof which engages supporting section 10 for supporting the product cards thereon.

A dispensing section 16 having arms 16A and 16B extends outwardly from supporting section 10.

With the arrangement described, product cards 12 are removed by sliding the product cards along supporting section 10 and dispensing section 16. It will be appreciated that a pilferer or the like can easily grasp a plurality of product cards 12 for easy removal from product dispenser 2. The present invention impedes this pilfering activity.

Figure 2:
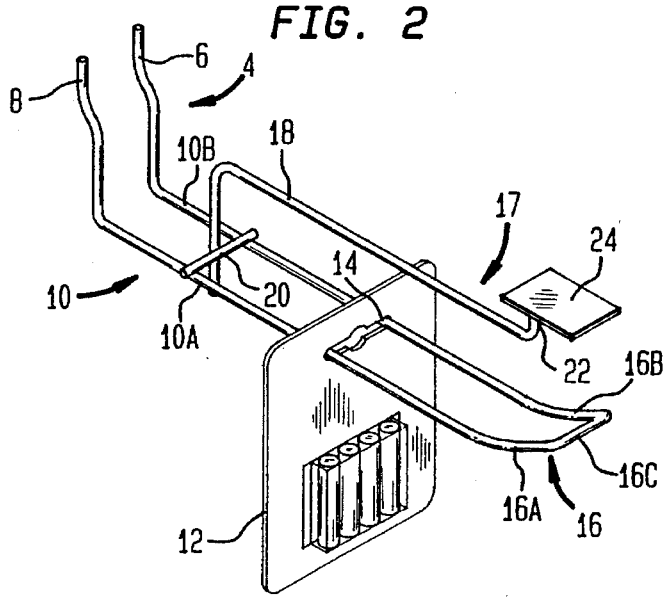
FIG. 2 is a perspective view illustrating a form of product dispenser in accordance with the invention.
Figure 4:
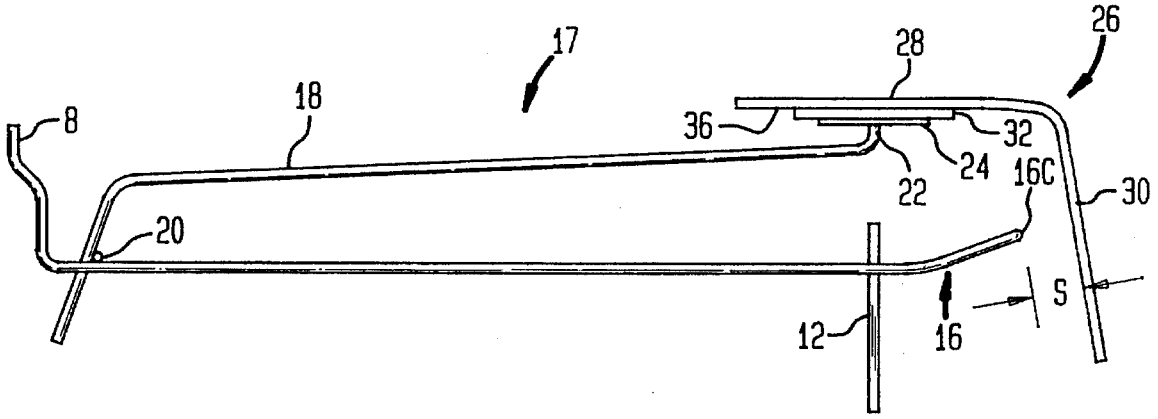
FIG. 4 is a side view illustrating the product dispenser shown in FIG. 2 with the retaining element shown in FIG. 3 arranged therewith, and best illustrating the feature of the invention wherein only a predetermined fixed quantity of product cards can be removed from the product dispenser.

Thus, and with reference to FIGS. 2 and 4, wherein components corresponding to those in FIG. 1 have corresponding numerical designations, the present invention features a product dispenser 17 which has all of the components of product dispenser 2 and includes in addition a bar 18 which is disposed between arms 10A and 10B via a crossbar 20 affixed to bar 18 and said arms so as to extend longitudinally and above card supporting section 10 and substantially parallel thereto so as to terminate near the extending free end 16C of dispensing section 16 of product dispenser 2. The terminal end of bar 18 includes an upwardly extending portion 22 which fixedly supports a platform 24 substantially parallel to bar 18.

Figure 3:
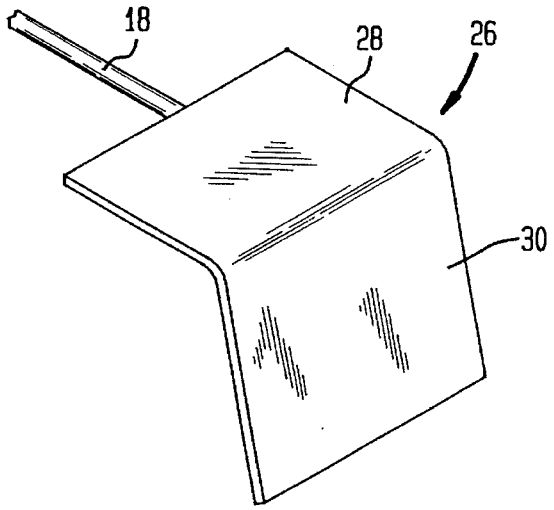
FIG. 3 is a perspective view illustrating a portion of the product dispenser shown in FIG. 2 with a retaining element arranged therewith in accordance with the invention.

A retaining element 26 shown generally in FIG. 3 is supported on platform 24 as will be hereinafter more particularly described with reference to FIGS. 5 and 6. Retaining element 26 includes a section 28 which is supported on platform 24 substantially parallel to the platform and a section 30 extending downwardly from section 28 for fixing the number of product cards 12 that may be removed from dispenser 2 to a predetermined quantity, as will be hereinafter described.

Figure 5:
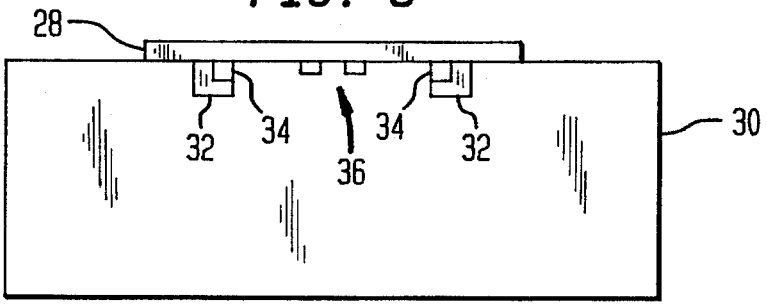
FIG. 5 is an end view best showing the structural features of the retaining element shown in FIGS. 3 and 4.
Figure 6:
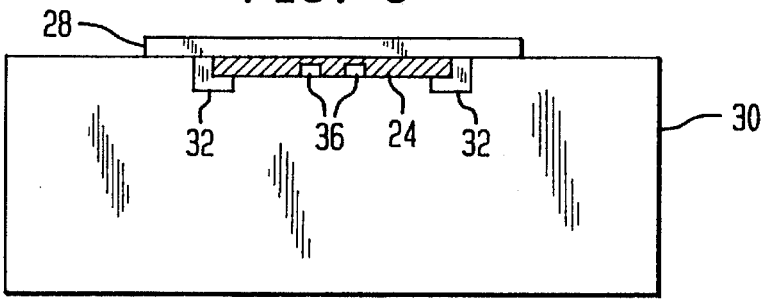
FIG. 6 is an end view showing the arrangement of the present invention wherein the retaining element is supported by the product dispenser.

With reference to FIGS. 4, 5 and 6, retaining element 26 includes a pair of parallel tracks 32 extending downwardly from section 28 thereof. Tracks 32 terminate at forward stops 34. A spring clip member 36 is disposed between parallel tracks 32 and ahead of the tracks as particularly shown in FIG. 4.

Platform 24 supports retaining element 26 when the platform is disposed in tracks 32. Retaining element 26 is urged forwardly until the rear edge of platform 24 abuts stops 32, whereby retaining element 26 is in a predetermined position for permitting only a fixed quantity of product cards 12 to be removed from product dispensing section 16. In this regard, it is noted that when urging the retaining element forwardly as described, spring clip 22 is displaced by platform 24 toward section 28 until the platform clears the spring clip and at which point the spring clip springs away from section 28 so as to provide a lock for the positioned retaining element. In order to remove the retaining element as may be desireable, spring clip 36 must be displaced toward section 28 so that retaining element 26 can be displaced rearwardly and thereby removed from platform 24. Thus, retaining element 26 is arranged so that it can be easily attached to platform 24 but requires an overt manipulation for being removed from the platform.

In regard to spring clip 36, the clip is integral with retaining element section 28 at the forward end of the clip to provide the required spring action for achieving the aforementioned displacement and springing for the purposes described.

It will now be recognized that retaining element 26 is supported by platform 24 in a fixed position relative to product card dispensing section 16 so that only a predetermined fixed quantity of product cards 12 can be easily removed from product dispenser 17. The fixed number of product cards that can be so removed is determined by the space S (FIG. 4) between portion 30 of dispensing element 26 and extending free end 16C of product dispensing section 16. Space S is such that the fingers of one desiring to remove a product card from the product dispenser can easily grasp only the fixed number of cards, i.e. the most forward of the plurality of cards which, as heretofore noted, is usually one. In this regard, it will be realized that the larger space S is, the larger is the number of product cards that can be easily grasped and hence removed at one time. Thus, in the usual situation where the number of product cards to be removed from the product dispenser is limited to one, the space is at a minimum so that anyone attempting to remove more than the one card would have to linger at the product card display so as to cause easier detection, as is desireable.

Thus, the advantageous feature of the invention is that when retaining element 26 is supported on platform 24 at a predetermined location as aforenoted, the fixed quantity of product cards that can be removed from product dispenser 17 at one time is assured. Further, retaining element 26 is designed so that it can be easily attached to the product dispenser but yet needs an overt manipulation on the part of a pilferer or the like via spring clip 36 to be removed and thus minimizes attempts to avoid the purposes of the invention.

It will be understood that product dispensing element 17, including bar 18 and and retaining element 26 can be made of a number of different materials such as metal, plastic or other materials as may be desireable, or may be fabricated of a combination of more than one material. In the preferred embodiment of the invention, the product dispensing element including the bar are of metal and the retaining element is of a transparent plastic material. Further, although a specific form of product dispenser has been described for purposes of illustrating the invention, other forms of product dispensers such as are commercially available, using a single or double hook or other configuration, may be adapted to use the invention as well.

With the above description of the invention in mind, reference is made to the claims appended hereto for a definition of the scope of the invention.

What is claimed is:

1. A product dispenser for dispensing products which are encapsulated on cards, comprising:

a mounting section;

an elongated card supporting section extending outwardly from the mounting section and supporting a plurality of cards;

a dispensing section extending outwardly from the supporting section and having an extending free end;

a member mounted to the supporting section and extending longitudinally and above the supporting section and substantially parallel thereto;

said member including means for supporting a retaining element at a fixed position relative to the extending free end of the dispensing section, whereby a fixed space is provided between said retaining element and said extending free end;

the retaining element includes a first section extending substantially parallel to said member and a second section extending downwardly from the first section;

the means for supporting the retaining element at a fixed position relative to the extending free end of the dispensing section includes means for supporting the first section of the retaining element;

the fixed space is provided between the second section of the retaining element and said extending free end;

the first section of the retaining element has a pair of downwardly extending parallel tracks;

the means for supporting the first section of the retaining element includes a platform supported by the member mounted to the supporting section and disposed in said pair of parallel tracks so that said retaining element is displaceable forwardly and rearwardly relative to said platform; and said fixed space being commensurate with a desired fixed quantity of the plurality of cards to be removed from the product dispenser by displacing said fixed quantity of cards forwardly relative to the mounting section along the supporting section and the dispensing section.

2. The product dispenser as described by claim 1, wherein:

stops are disposed at the forward end of the tracks, with the platform abutting said stops whereby the fixed space is provided between the second section of the retaining element and said extending free end.

3. The product dispenser as described by claim 1, including:

a spring clip disposed between the pair of downwardly extending parallel tracks ahead of said pair of tracks, and having a forward edge integral with the first section of the retaining element so as to be displaceable away from and toward said first section;

said spring clip being displaced toward the first section of the retaining element by said first section until said first section is displaced rearwardly so that the platform clears said spring clip, whereupon said spring clip springs away from said first section to lock the retaining element on said platform; and said spring clip being displaceable toward said first section, whereupon the retaining element is unlocked and is displaced forwardly so as to be removed from the platform.

4. In a product dispenser of the type for dispensing products encapsulated on product cards and including a mounting section, an elongated card supporting section extending outwardly from the mounting section and supporting a plurality of cards, a dispensing section extending outwardly from the supporting section and having an extending free end, the improvement comprising:

a member mounted to the supporting section and extending longitudinally and above the supporting section and substantially parallel thereto;

said member including means for supporting a retaining element at a fixed position relative to the extending free end of the dispensing section, whereby a fixed space is provided between said retaining element and said extending free end;

said fixed space being commensurate with a desired fixed quantity of cards to be removed from the product dispenser by displacing said fixed quantity of cards forwardly relative to the mounting section along the supporting section and the dispensing section;

the retaining element includes a first section extending substantially parallel to said member and a second section extending downwardly from the first section;

the means for supporting the retaining element at a fixed position relative to the extending free end of the dispensing section includes means for supporting the first section of the retaining element;

the fixed space is provided between the second section of the retaining element and said extending free end;

the first section of the retaining element has a pair of downwardly extending parallel tracks; and the means for supporting the first section of the retaining element includes a platform supported by the member mounted to the supporting section and disposed in said pair of parallel tracks so that said retaining element is displaceable forwardly and rearwardly relative to said platform.

5. The product dispenser as described by claim 4, wherein:

stops are disposed at the forward end of the tracks, with the platform abutting said stops whereby the fixed space is provided between the second section of the retaining element and said extending free end.

6. The product dispenser as described by claim 4, including:

a spring clip disposed between the pair of downwardly extending parallel tracks ahead of said pair of tracks, and having a forward edge integral with the first section of the retaining element so as to be displaceable away from and toward said first section;

said spring clip being displaced toward the first section of the retaining element by said first section until said first section is displaced rearwardly so that the platform clears said spring clip, whereupon said spring clip springs away from said first section to lock the retaining element on said platform; and said spring clip being displaceable toward said first section, whereupon the retaining element is unlocked and is displaced forwardly so as to be removed from the platform.

* * * * *